US005927872A

United States Patent [19]

Yamada

[11] Patent Number: 5,927,872

[45] Date of Patent: Jul. 27, 1999

[54] HANDY PRINTER SYSTEM

[75] Inventor: Norihide Yamada, Tokyo, Japan

[73] Assignee: Hewlett-Packard Company, Palo Alto, Calif.

[21] Appl. No.: 09/124,395

[22] Filed: Jul. 29, 1998

[30] Foreign Application Priority Data

Aug. 8, 1997 [JP] Japan ..... 9-215244

[51] Int. Cl.[6] ..... B41J 3/36

[52] U.S. Cl. ..... 400/88

[58] Field of Search ..... 400/88

[56] References Cited

U.S. PATENT DOCUMENTS

| | | | |
|---|---|---|---|
| 4,412,232 | 10/1983 | Weber | 346/140 |
| 4,899,228 | 2/1990 | Sano | 358/473 |
| 4,915,027 | 4/1990 | Ishibashi | 101/486 |
| 4,947,262 | 8/1990 | Yajima | 358/296 |
| 4,999,016 | 3/1991 | Suzuki | 400/88 |
| 5,024,541 | 6/1991 | Tsukada | 400/88 |
| 5,240,334 | 8/1993 | Epstein | 400/88 |
| 5,262,804 | 11/1993 | Petigrew | 346/140 |
| 5,311,208 | 5/1994 | Burger et al. | 345/163 |
| 5,520,470 | 5/1996 | Willett | 400/88 |
| 5,578,813 | 11/1996 | Allen | 250/208.1 |
| 5,593,236 | 1/1997 | Bobry | 400/88 |
| 5,638,463 | 6/1997 | Ohshita | 382/195 |
| 5,761,480 | 6/1998 | Fukada | 395/400 |

*Primary Examiner*—Edgar Burr
*Assistant Examiner*—Charles H. Nolan, Jr.

[57] ABSTRACT

A system and a method of printing an image represented by a frame of image data utilize a hand-held printer having optical sensors for tracking positions of the hand-held printer relative to the surface of a print medium during a printing process. The change in position of the hand-held printer during the printing process is monitored in real time using navigation information generated by the optical sensors. Each optical sensor contains an array of optoelectronic elements to capture images of the surface of a print medium at fixed time intervals. Preferably, the optical sensors can detect slight pattern variations on the print medium, such as paper fibers or illumination patterns formed by highly reflective surface features and shadowed areas between raised surface features. These features can then be used as references for determining the position and the relative movement of the hand-held printer. During the printing process, the printed portions of the image can also be used as reference positions by the hand-held printer. In the preferred embodiment, the hand-held printer contains a navigation processor and a printer driver. Using the printer driver, the navigation processor drives the hand-held printer to print segments of the image onto a print medium as the hand-held printer travels across the print medium during a printing process. Each segment of the image is printed onto a particular location on the print medium to form a composite of the image.

19 Claims, 8 Drawing Sheets

HANDY PRINTER SYSTEM

TECHNICAL FIELD

The invention relates generally to printing methods and systems and more particularly to approaches for determining a sequence for depositing ink onto a print medium.

BACKGROUND ART

A stand-alone printer is commonly used in conjunction with a computer system in order to print images in the form of pictures, text, and/or graphics that may be displayed on a monitor of the computer system. A variety of technologies can be utilized by printers, including inkjet technology and electrophotographic, or laser, technology.

A printing process using inkjet technology involves moving an inkjet cartridge horizontally along a vertically moving print medium, such as a sheet of paper, and sequentially depositing ink by ejecting the ink onto the paper to form an image. For color inkjet printing, the inkjet cartridge includes jets that are connected to four ink reservoirs. The reservoirs contain cyan, magenta, yellow, or black ink. For grayscale printing, the inkjet cartridge typically includes a single reservoir of black ink.

A printing process using electrophotographic technology involves creating neutral regions on a positively charged drum, which represents a reverse image of the image to be printed. The drum is then dusted with positively charged particles, or toner. The toner is attracted to the neutral regions on the drum. When a negatively charged paper comes in contact with the drum, the attached toner transfers to the paper to form the image on the paper.

Regardless of the technology utilized, a conventional stand-alone printer is typically fed with a print medium in which an image is to be printed. The approach to feeding the print medium dictates the minimum size of the printer. For example, in order to print onto a paper of letter size, i.e. 21.59 cm×27.94 cm, a stand-alone printer must be at least 21.59 cm wide to accommodate the letter-size paper. Since print media must be fed into a stand-alone printer, an image cannot be printed onto a rigid paper or other print media that cannot be fed into the stand-alone printer.

A solution to the minimum size requirement of a conventional stand-alone printer and the limited types of print media that can be used to print an image is a hand-held printer that can be manually manipulated over a print medium. Because the print medium is not fed into the hand-held printer, the hand-held printer can be made much smaller than the stand-alone printers and can print on a greater variety of print media. U.S. Pat. No. 5,240,334 to Epstein et al. (hereinafter Epstein) describes a hand-held printer that is coupled to a host computer. The hand-held printer described in Epstein is an inkjet printer that can be used to print addresses on envelopes. The hand-held printer is used in conjunction with a base unit that has grooves to guide the printer during a printing process. The Epstein hand-held printer contains a mechanical device with a ball that rolls on the print medium during the printing process. The rotation of the ball is used to generate data for tracking the vertical and horizontal movement of the printer.

A concern with regard to the Epstein printer is that the ball used for tracking the printer may skid during the printing process. The effect of such skidding is to generate incorrect data relating to the movement of the printer. Another concern with the use of the ball for tracking is that the ball must be in constant contact with a print medium. If the hand-held printer of Epstein is temporarily removed from the print medium during a printing process, the hand-held printer must be placed back on the print medium at the precise location where the printing ceased in order to resume the printing process.

A similar inkjet hand-held printer is described in U.S. Pat. No. 5,311,208 to Burger et al. (hereinafter Burger) that is also connected to a host computer. The hand-held printer described in Burger includes a computer mouse that is integrated into the housing of the hand-held printer. In one embodiment, a support unit is utilized to guide the printer across a print medium in a horizontal direction. Similar to the printer described in Epstein, the hand-held printer of Burger also uses a mechanical device with a ball to track the printer movement during the printing process. The same concerns of Epstein are also present in the hand-held printer of Burger.

While the known hand-held printers operate well for their intended purpose, what is needed is an efficient hand-held printer with a non-mechanical tracking device.

SUMMARY OF THE INVENTION

A system and a method of printing an image represented by a frame of image data utilize a hand-held printer having at least one optical sensor for tracking navigation of the hand-held printer relative to the surface of a print medium. The change in position of the hand-held printer is monitored in real time using navigation information generated by monitoring the outputs of the optical sensors. The tracking feature of the hand-held printer allows an operator to print an image onto a print medium by moving the hand-held printer in a free-hand manner across the print medium.

In the preferred embodiment, the hand-held printer includes four optical sensors for tracking the position of the hand-held printer relative to the print medium. However, fewer optical sensors may be utilized. Each optical sensor contains an array of optoelectronic elements to capture images of the surface of a print medium at fixed time intervals. Preferably, the optical sensors detect slight pattern variations on the print medium, such as paper fibers or illumination patterns formed by highly reflective surface features and shadowed areas between raised surface features. These features can then be used as references for determining the movement of the hand-held printer. Alternatively, the optical sensors can detect printed features on a print medium to be used as references, such as graph paper lines or custom designs on the surface of the print medium. By comparing images of the surface of a print medium captured at different times, the movement of the hand-held printer can be determined. The navigation information generated by the optical sensors is utilized to correlate the segment of the image to be printed and the corresponding location of that segment on a print medium.

In operation, a communication link is established between the hand-held printer and a host system. The host system can be a computer system. In the preferred embodiment, the communication link is a wireless connection, such that information is transmitted and received in the form of infrared or radio frequency signals. During a printing process, the hand-held printer is manually manipulated across a print medium. The navigation information generated by the optical sensors is relayed to a processor in the host system. The host system then transmits data that represents the portion of the image to be printed at a particular position on a print medium as the hand-held printer travels over that particular position. The data is sent in the form of print data to drive an inkjet cartridge to deposit droplets of ink. While inkjet printing is preferred, other printing devices may be utilized.

In an alternative embodiment, the navigation information is processed within the hand-held printer. In addition, the image data to be printed is converted into print data by the hand-held printer. The conversion of the image data into print data is accomplished by a printer driver, which is typically implemented in computer software. The dynamic arrangement of segments of print data may be implemented at the driver level, or at a level above or below the driver level. That is, the printer driver may direct print data in an arrangement of segments responsive to the reception of navigation information. Alternatively, the dynamic arrangement of segments may be implemented prior to the printer driver by arranging the image information that is serially conducted to the printer driver. As a third alternative, the print data from the printer driver may be temporarily stored in a buffer, and the dynamic arrangement may be the result of extracting print data from the buffer in a sequence dictated by the navigation information.

By continuously monitoring the progress of the printing process, the hand-held printer is able to distinguish printed areas on the print medium versus to-be printed areas on the print medium. The monitoring allows the hand-held printer to only print when the hand-held printer is on the to-be printed areas on the print medium.

An advantage of the invention is that since the tracking operation is electrical rather than mechanical, tracking errors due to mechanical failures are eliminated.

Another advantage of the invention is that the optical tracking feature of the hand-held printer allows the operator to continue the printing process even though the hand-held printer is temporarily removed from a print medium. The hand-held printer can use printed portions of the image or other references on the print medium to determine the position of the hand-held printer and to continue to print the remaining portion of the image.

DETAILED DESCRIPTION

Figure 1:
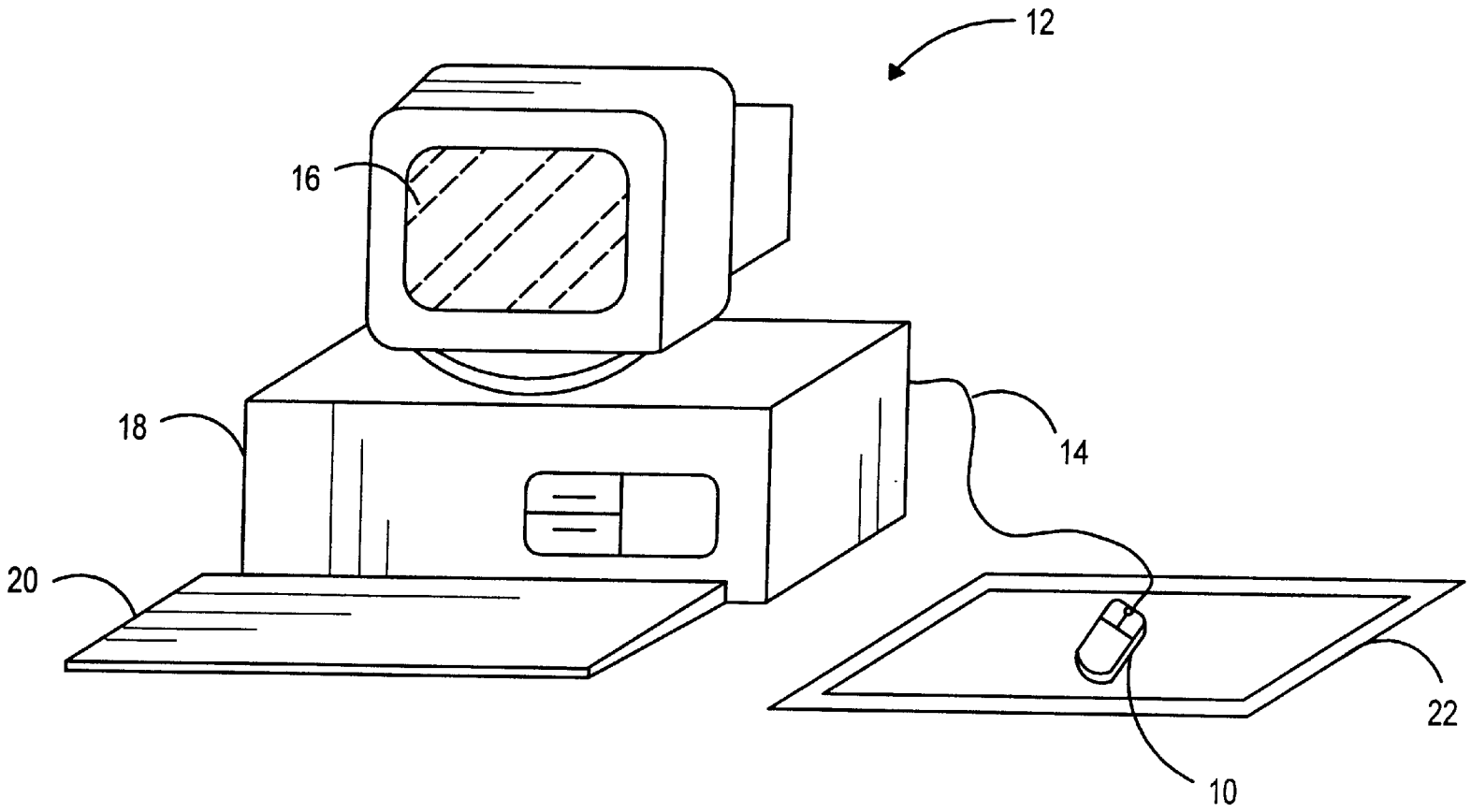
FIG. 1 is an illustration of a hand-held printer that is connected to a host computer system by a cable in accordance with one embodiment of the present invention.

In FIG. 1, a hand-held printer 10 embodying the present invention is shown connected to a host computer system 12 by a cable connection 14. The hand-held printer 10 has an appearance of a conventional computer mouse. However, the appearance of the hand-held printer 10 can take on a different form without affecting the utility of the invention. The host computer system 12 includes a monitor 16, a computer 18, and a keyboard 20. Although the host computer system 12 is shown as a desktop computer, the host computer system 12 can be a laptop computer. The hand-held printer 10 is situated on a print medium 22. The print medium 22 can be an ordinary paper, a glossy paper, a cardboard, a file folder, a page in a notebook, a side of a box, or other similar medium that has a surface for an image to be printed. The print medium 22 could even be a sheet of wood.

In another embodiment, the cable connection 14 is not needed. Instead, a wireless connection is established between the host computer system 12 and the hand-held printer 10. In this embodiment, the computer 18 includes a transceiver (not shown) for transmitting and receiving data to and from the hand-held printer 10. The data can be transmitted in a form of infrared or radio frequency signals. In addition, the hand-held printer 10 includes a corresponding transceiver (not shown) for receiving and transmitting data from and to the computer 18. The use of the transceivers eliminates the need for a physical connection between the host computer system 12 and the hand-held printer 10.

The hand-held printer 10 functions as a conventional printer, although it is significantly more compact than a stand-alone printer. An image in the form of a picture, text, and/or graphics is generated in or transferred to the host computer system 12. The image can be displayed on the monitor 16 of the host computer system 12. Using a wordprocessor, photo-manipulation, or graphics software, the image displayed on the monitor 16 can be selected to be printed. In one embodiment, a frame of image data that represents a page of an image is converted within the computer 18 to print data in order to drive a printing mechanism in the hand-held printer 10. The print data is then sent to the hand-held printer 10 in a piecemeal fashion. In another embodiment, the entire frame of image data is transferred to the hand-held printer 10. The conversion to print data is accomplished within the hand-held printer 10. The printing operation of the hand-held printer 10 will be described below.

Figure 2:
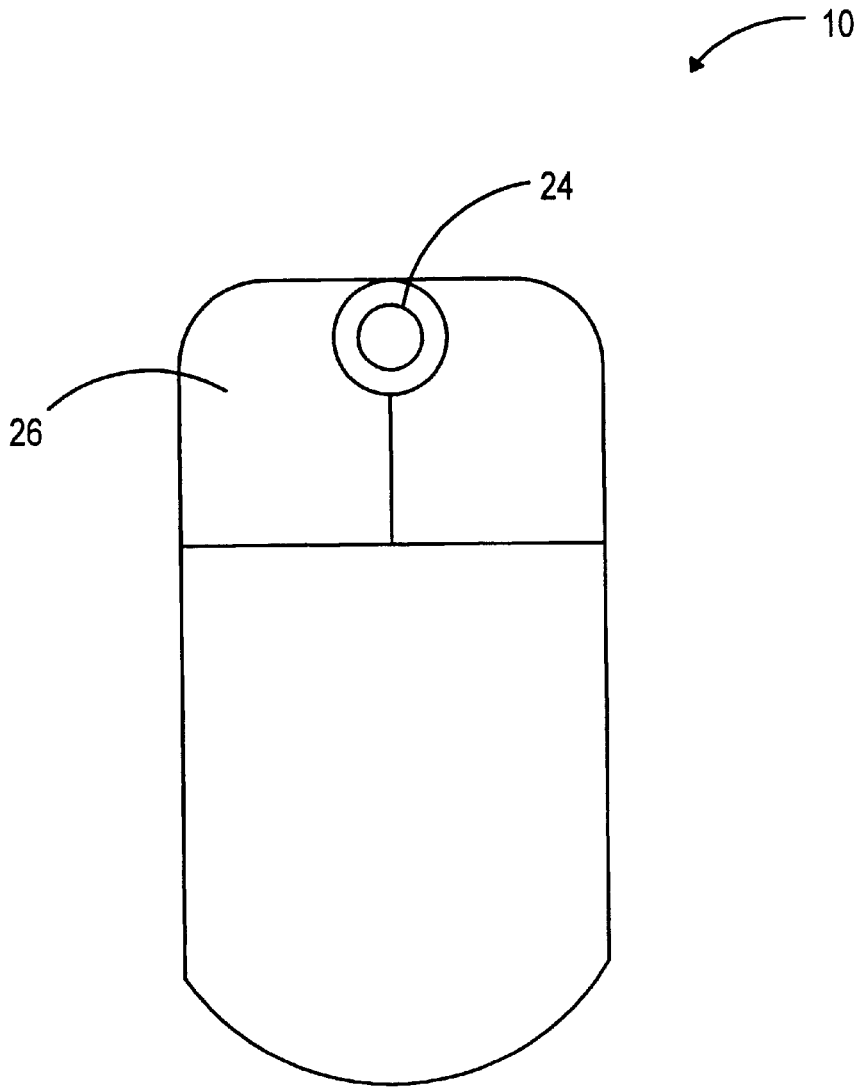
FIG. 2 is a top view of the hand-held printer in accordance with the present invention.

Turning now to FIG. 2, a top view of the hand-held printer 10 is shown. A light indicator 24 is situated next to a print button 26 on the exterior of the hand-held printer 10. The light indicator 24 signals to a user when the conditions are such that a printing process can begin or continue. When an error occurs during the printing process, the light indicator 24 can be designed to turn "off" as an error signal to the user. Another situation in which the light indicator 24 can be designed to turn "off" is when the hand-held printer 10 is lifted from a print medium during the printing process. The printing process is activated by the print button 26. However, during the printing process, the actual printing, i.e. depositing ink onto a print medium, occurs only when the hand-held printer 10 is manually maneuvered across the print medium with the print button 26 activated. In other words, the actual printing occurs only when the hand-held printer 10 is positioned on the print medium, the print button 26 is activated, and the hand-held printer 10 is moving. The circuitry associated with the print button 26 can be configured to require continuous depression by the user during the printing process. Alternatively, the print button circuitry can be designed to be continuously activated when the print button 26 is depressed once.

Figure 3:
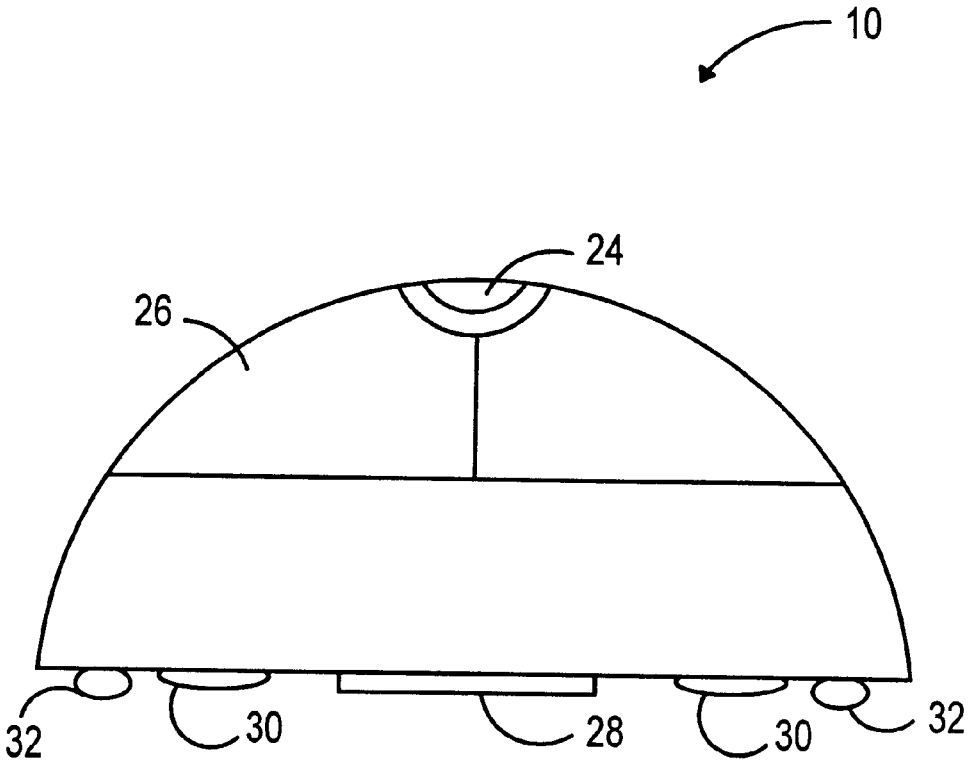
FIG. 3 is a front view of the hand-held printer in accordance with the present invention.

In FIG. 3, a front view of the hand-held printer 10 is illustrated. The light indicator 24 and the print button 26 that were described in reference to FIG. 2 are shown. On the bottom of the hand-held printer 10, a portion of an inkjet cartridge 28 is situated between two navigation sensors 30. Each navigation sensor 30 include a lens and an array of optoelectronic elements. The size of the array of optoelectronic elements can vary, depending on the type of optoelectronic elements used and the desired area of a print medium to be captured by the navigation sensors 30. The navigation sensors 30 are used to track movement of the hand-held printer 10 relative to a print medium during a printing process. The inkjet cartridge 28 can be a conventional inkjet cartridge, such as the inkjet cartridges that are used in Hewlett Packard's line of Deskjet printers. However, the inkjet cartridge 28 can be specially designed to have a greater number of inkjet orifices in order to print wider areas on a print medium as the inkjet cartridge 28 scans over the print medium. The inkjet cartridge 28 can contain only black ink, for grayscale printing. Alternatively, the inkjet cartridge 28 can contain cyan, magenta, yellow, and black ink, for color printing.

Next to the navigation sensors 30 are two support spacers 32. The support spacers 32 ensure that proper distance is maintained between the inkjet orifices of the inkjet cartridge 28 and a print medium during a printing process when the hand-held printer 10 is positioned on the print medium. In the preferred embodiment, the hand-held printer 10 includes two additional navigation sensors and two additional support spacers.

Figure 4:
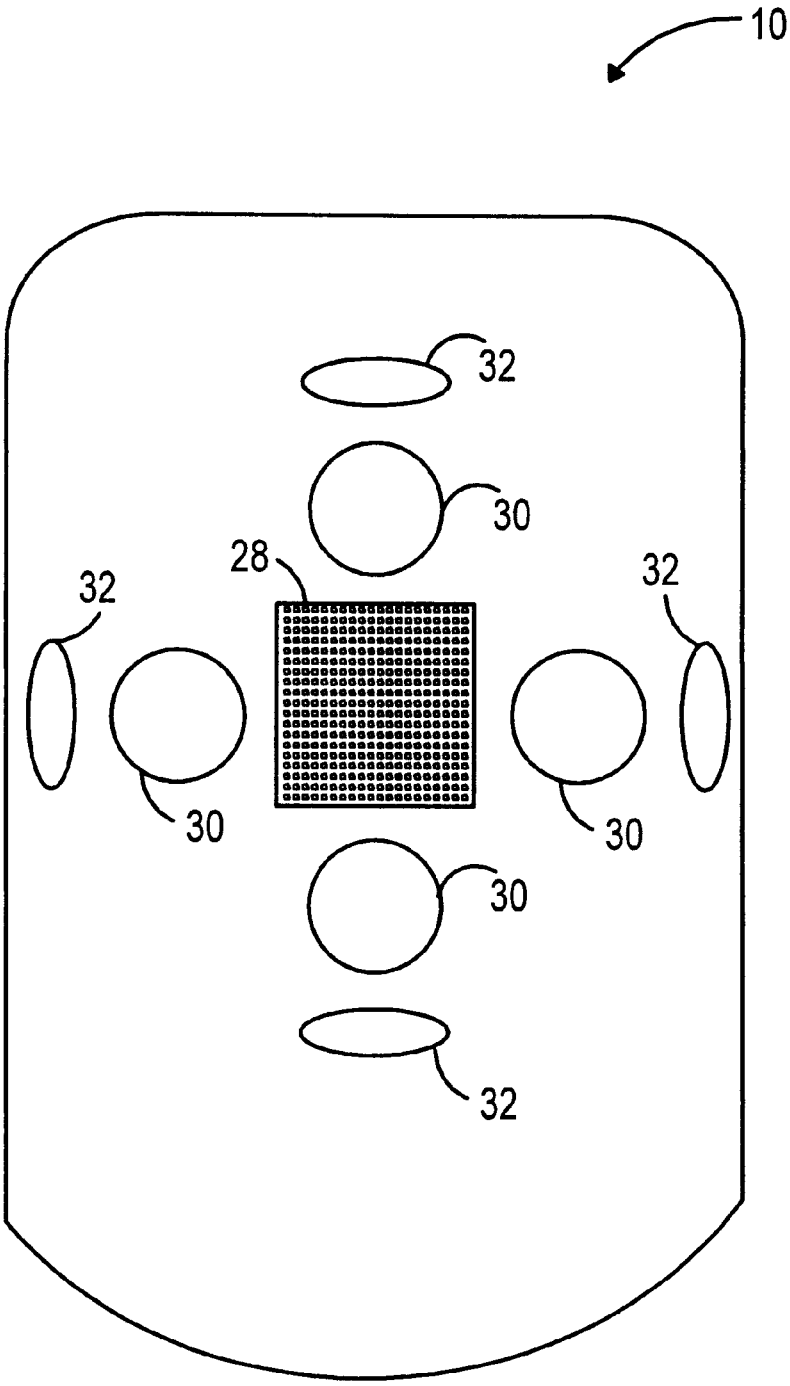
FIG. 4 is a bottom view of the hand-held printer in accordance with the present invention.

Turning to FIG. 4, a bottom view of the hand-held printer 10 is shown. Four navigation sensors 30 and four support spacers 32 are positioned around the inkjet cartridge 28. The precise positions of the inkjet cartridge 28, the four navigation sensors 30, and the four support spacers 32 are not critical to the invention. In addition, the number of the navigation sensors 30 and the number of support spacers 32 are not critical to the invention. The hand-held printer 10 can operate well with only one navigation sensor 30. The support spacers 32 may be replaced by bumps, or indentations, on the housing of the hand-held printer 10.

The navigation sensors 30 utilize a tracking process disclosed in U.S. Pat. No. 5,578,813 to Allen et al. (hereinafter Allen), which is assigned to the assignee of the present invention and is incorporated by reference. The Allen patent describes a scanning device for simultaneously acquiring image and navigation information. A hand-held scanning device is moved relative to a document having an image to be captured. Simultaneously, one or more navigation sensors are used to view features on the scanned document and to generate navigation information. This same approach can be used in the printing process of the hand-held printer 10. In a sophisticated application of this approach, the features that are imaged and used to determine position information may be paper fibers or illumination patterns formed by highly reflective surface features and shadowed areas between raised surface features. In a less sophisticated application, the features that are imaged may be reference features, such as graph paper lines on the surface to which the image is to be printed.

Figure 5:
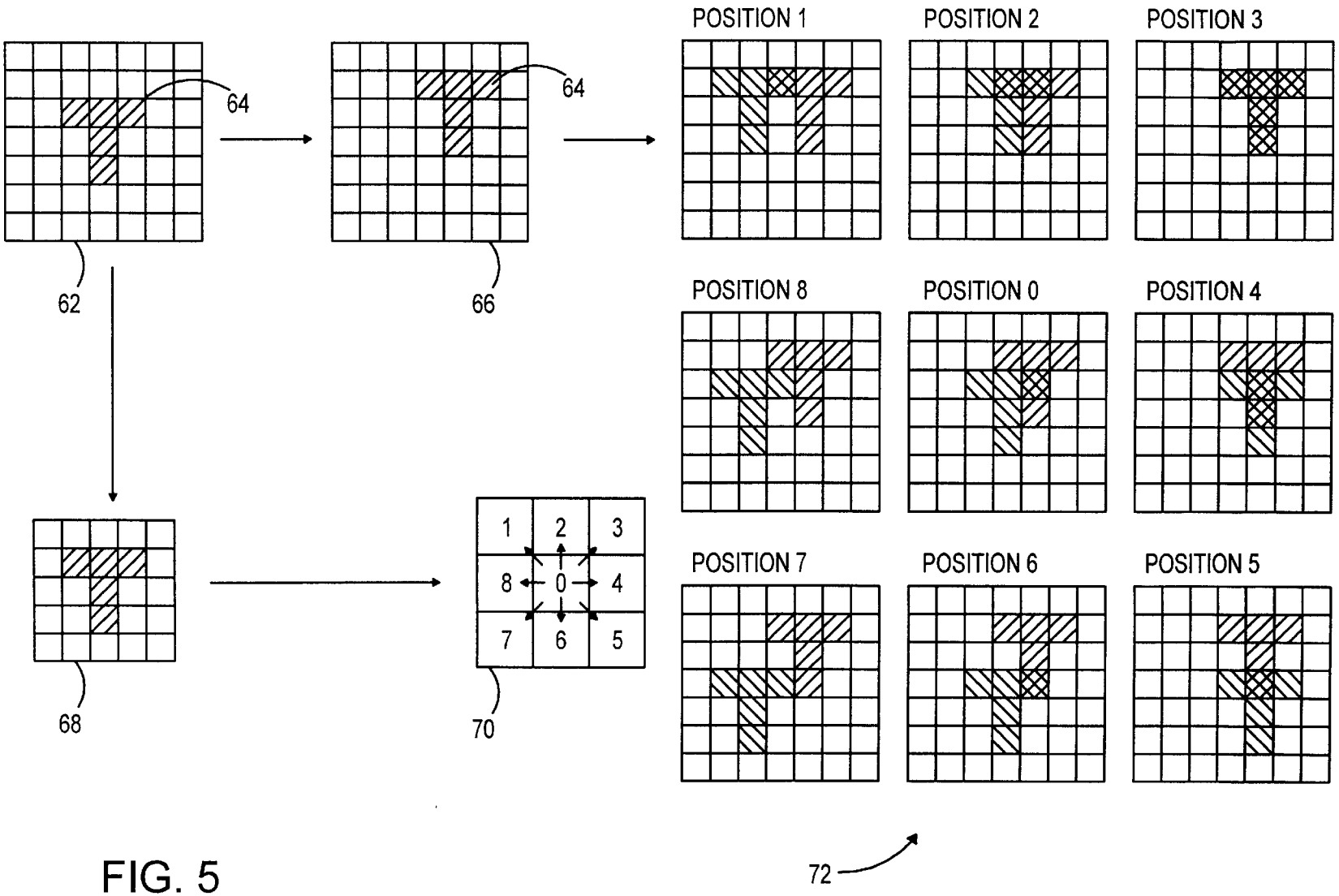
FIG. 5 is a conceptual representation of generating navigation information using navigation sensors of the hand-held printer.

FIG. 5 is a conceptual representation of generating navigation information using the navigation sensors 30 of the hand-held printer 10. A reference frame 62 of a surface on which an image is to be printed is shown as having a T-shaped feature 64. The size of the reference frame depends upon factors such as the maximum scanning speed of the hand-held printer 10, the dominant spatial frequencies of the image of the structural features, and the image resolution of the navigation sensors 30. A practical size of the reference frame for a navigation sensor 30 that is thirty-two pixels by sixty-four pixels is 24×56 pixels.

At a later time ($\Delta t$), the navigation sensor 30 acquires a sample frame 66 of the surface on which the image is being printed. The sample frame 66 is acquired after the hand-held printer 10 has been displaced with respect to the position in which frame 62 was acquired. The duration $\Delta t$ is preferably set such that the relative displacement of the T-shaped feature 64 is in the range from about 0.5 pixel to about 1.5 pixel of the navigation sensor at the velocity of translation of the scanning device. However, durations outside this range may be used. An acceptable duration is 50 $\mu$s for velocities of 0.45 meters/sec at 600 dpi.

If the hand-held printer 10 has moved during the time period between acquiring the reference frame 62 and the time at which the sample frame 66 is acquired, the first and second images of the T-shaped feature will be ones in which the feature has shifted. While the preferred embodiment is one in which $\Delta t$ is less than the time that allows a full-pixel movement, the schematic representation of FIG. 5 shows the feature 64 as having shifted upwardly and to the right by one full pixel. The full-pixel shift is assumed only to simplify the representation.

Element 70 in FIG. 5 represents a sequential shifting of the pixel values of frame 68 into the eight nearest-neighbor pixels. That is, step "0" does not include a shift, step "1" is a diagonal shift upward and to the left, step "2" is an upward shift, etc. In this manner, the pixel-shifted frames can be combined with the sample frame 66 to produce the array 72 of position frames shown in FIG. 5. The position frame designated as "Position 0" does not include a shift, so that the result is merely a combination of frames 66 and 68. "Position 3" has the minimum number of shaded pixels and, therefore, is the frame with the highest correlation. Based upon the correlation results, the position of the T-shaped feature 64 in the sample frame 66 is determined to be a diagonal rightward and upward shift relative to the position of the same feature in the earlier-acquired reference frame 62, which implies that the hand-held printer 10 has moved leftwardly and downwardly during the time $\Delta t$.

Figure 6:
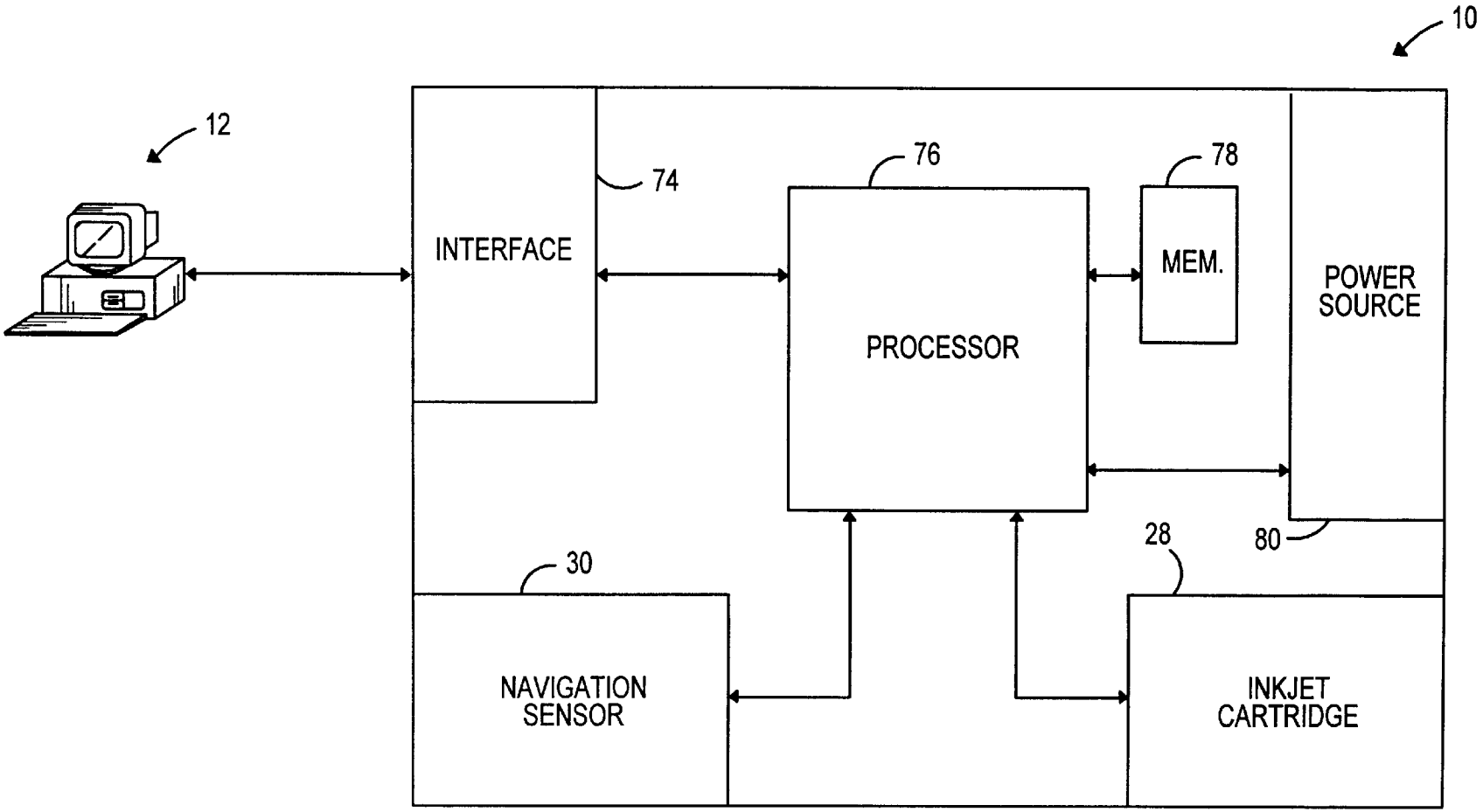
FIG. 6 is a block diagram of the components of the hand-held printer.

In FIG. 6, a block diagram of the components of the hand-held printer 10 is illustrated. An interface 74 is connected to a processor 76. The interface 74 can be a connector for a cable to establish a communication link between the hand-held printer 10 and the host computer system 12. In an alternative embodiment, the interface 74 is a transceiver. In this embodiment, infrared or radio frequency signals are utilized to communicate between the hand-held printer 10 and the host computer system 12. The processor 76 is also connected to the navigation sensor 30 and the inkjet cartridge 28. Although only a single navigation sensor 30 is shown, the hand-held printer 10 can embody additional navigation sensors. In the preferred embodiment, the hand-held printer 10 has four navigation sensors. Similarly, additional inkjet cartridges can be utilized. However, due to the relatively large size of an inkjet cartridge, a single inkjet cartridge having a large area for ejecting ink is preferred.

Also connected to the processor 76 is memory 78 and a power source 80. The power source 80 may be a battery to supply power to the electronic components of the hand-held printer 10. The battery may be a rechargeable nickel-cadmium battery or a conventional alkaline battery. The need for the power supply 80 can be eliminated if a cable is used to establish the communication link between the hand-held printer 10 and the host computer system 12. A supply of power can be transferred from the host computer system 12 to the hand-held printer 10 through the cable.

The memory 78 may be a conventional dynamic random access memory device. The storage capacity of the memory 78 can vary depending on the number of optical sensors utilized by the hand-held printer 10. The capacity of the memory 78 is not crucial to the invention. The memory 78 may store printer driver software pre-programmed to drive the inkjet cartridge 28. In another embodiment, the memory 78 is coupled to read-only memory (not shown) that is programmed with the printer driver software.

In an alternative embodiment, the hand-held printer 10 does not contain the processor 76 and the memory 78. The functions of the processor 76 and the memory 78 are performed by the host computer system 12. However, the printing operation of the hand-held printer 10 in this embodiment functions in the same manner as described below.

The operation of the hand-held printer 10 will be described with reference to FIGS. 1, 4, 5, 6, and 7. First, an image in the form of a picture, text, and/or graphics is displayed on the monitor 16 of the host computer system 12 using wordprocessor, photo-manipulation, or graphics software. If the displayed image is to be printed, a user initiates the printing process by inputting the required print command into the computer 18 through print button 26 on the printer 10, the keyboard 20 or a computer mouse (not shown). A frame of image data, representing the displayed image in digital form, is transmitted to the hand-held printer 10. In one embodiment, the frame of image data is transferred to the hand-held printer 10 through the cable connection 14. In another embodiment, the frame of image data is transferred to the hand-held printer 10 as infrared or radio frequency signals.

The frame of image data is received by the interface 74 and relayed into the memory 78 in the hand-held printer 10. Meanwhile, the user places the hand-held printer 10 on a print medium such as a sheet of paper. Preferably, the hand-held printer 10 is placed on a designated starting position on the paper. If the hand-held printer 10 is programmed, as a default, to begin printing the upper left corner of the image, the starting position is where the user desires the upper left corner of the image to be printed. Other locations of the image can be programmed to be printed first. The light indicator 24 on the hand-held printer 10 turns "on" at this time to signal that the hand-held printer 10 is ready to print. The user then activates the print button 26 and begins to manually maneuver the hand-held printer 10 across the paper, scanning the area of the paper in which the image is to be printed. In an alternative method, the hand-held printer 10 is scanned to find a corner of the paper, for example, the top left corner. The corner will be used as a reference for printing the image onto the paper. In this embodiment, the light indicator 24 will not turn "on" until the hand-held printer 10 determines the position of the inkjet orifices relative to the corner.

When the hand-held printer 10 is moved during the printing process, the navigation sensors 30 determine the relative movement of the hand-held printer 10 with respect to the paper. Using the approach described above in reference to FIG. 5, the navigation sensors 30 capture new frames of reference data that are compared with captured frames by the processor 76 to monitor the movement of the hand-held printer 10. The frame of image data to be printed is converted by the processor 76 into print data. The processor 76 sends to the inkjet cartridge 28 that portion of the print data representing the portion of the image that needs to be printed, as determined at each cycle ($\Delta t$) in which the hand-held printer 10 has been moved. The conversion of the image data into print data is accomplished by a printer driver (not shown), which is typically implemented in computer software. The dynamic arrangement of segments of print data to correspond to the dynamic movement of the printer 10 may be implemented at the driver level, or at a level above or below the driver level. That is, the printer driver may direct print data in an arrangement of segments responsive to the reception of navigation information. Alternatively, the dynamic arrangement of segments may be implemented prior to the printer driver by arranging the image information that is conducted to the printer driver. As a third alternative, the print data from the printer driver may be temporarily stored in a buffer, and the dynamic arrangement may be the result of extracting print data from the buffer in an arrangement dictated by the navigation information.

Depending on the new position of the hand-held printer 10, the processor 76 sends corresponding print data to the inkjet cartridge 28. In this manner, the whole image is printed when the hand-held printer 10 has scanned the entire area of the paper in which the image is to be printed. During the printing process, the hand-held printer 10 can be configured to update the host computer system 12 by transmitting information concerning the printed areas versus the areas yet to be printed. This information can be used by the host computer system 12 to highlight the portion of the printed image in the displayed image on the monitor, allowing the user to determine the progress of the printing process. This information is also utilized by the hand-held printer 10 to ensure that the hand-held printer 10 will not reprint over a printed area when the hand-held printer 10 is positioned over the printed area.

In many instances, the hand-held printer 10 will scan an area previously printed or missed portion of the paper. As described above, the hand-held printer 10 will not print over a printed area. In a similar manner, when the hand-held printer 10 is scanned over the missed area, the hand-held printer 10 will print the corresponding portion of the image to be printed onto the missed area.

Figure 7:
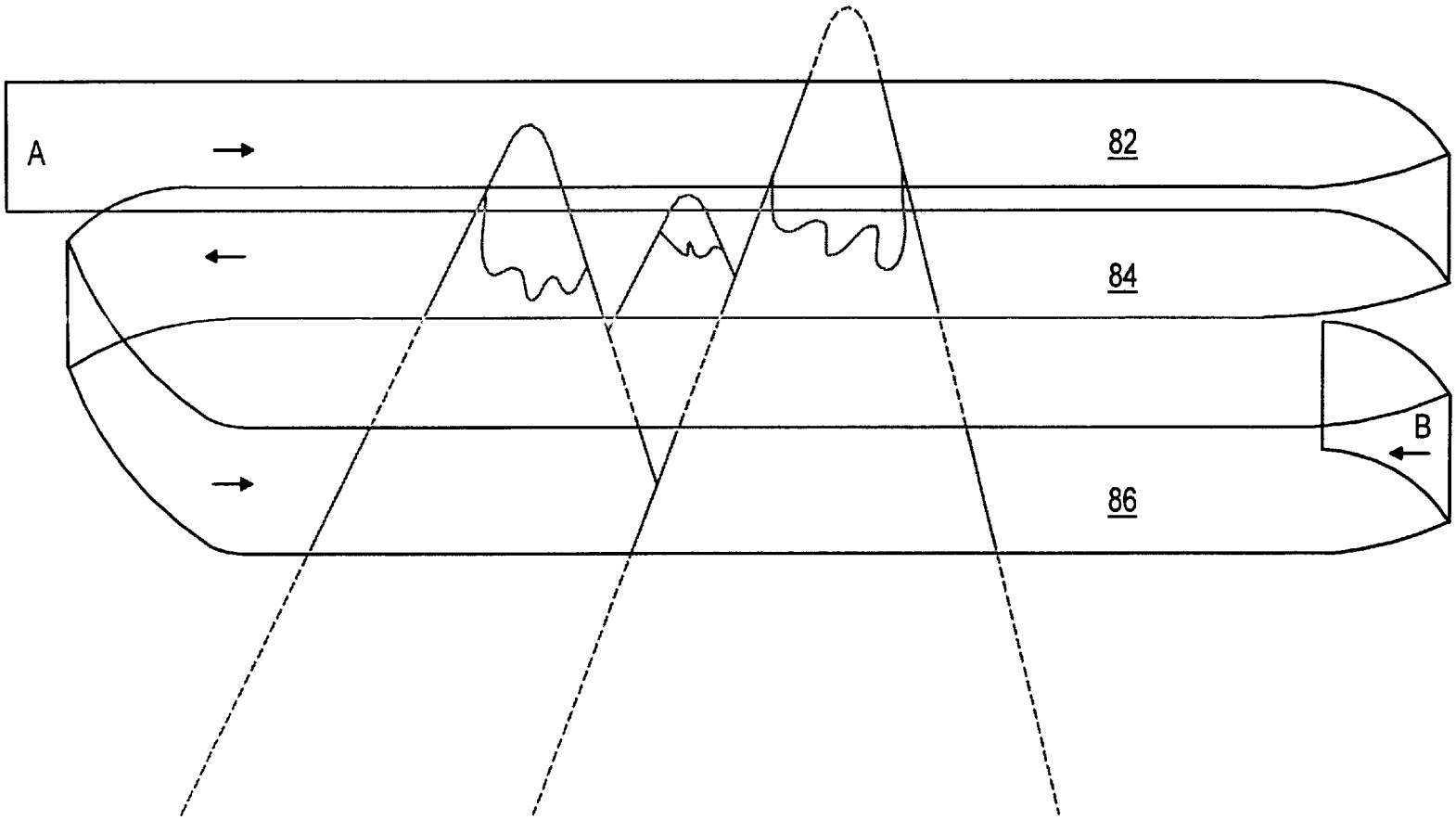
FIG. 7 is an illustration of a printing process using the hand-held printer in accordance with the present invention.

In FIG. 7, an illustration of the printing process is shown. An image of three mountain peaks is visible in FIG. 7. The solid lines of the mountains represent the printed portion of the image, while the dotted lines represent the portion of the image that needs to be printed. Swaths 82, 84, and 86 illustrates the path of the inkjet orifices of the hand-held printer 10 over a print medium. The hand-held printer 10 has traveled from point A to point B. The swath 82 represents a left to right path of the hand-held printer 10. During the passage of the hand-held printer 10 over the swath 82, the portion of the image within the swath 82 was printed. The swath 84 represents a right to left path of the hand-held printer. The upper portion of the swath 84 overlaps the bottom of the swath 82. As described above, the hand-held printer 10 does not print over a printed portion of a print medium. The overlap of the swaths 82 and 84 ensures that there are no missed areas on the print medium between the swaths 82 and 84. The swath 86 represents another left to right path of the hand-held printer 10. However, the swath 86 does not overlap a lengthwise edge of the swath 84. The result is that a portion of the print medium has been missed by the printer. As indicated by the dotted lines of the mountains between the swaths 84 and 86, the area between the swaths 84 and 86 needs to be printed. In order to print the missed portion of the print medium, the user need only to scan over the missed area with the hand-held printer 10.

Assuming the hand-held printer 10 was lifted away from the print medium at point B, the user can print the missed portion by placing the hand-held printer 10 back onto the print medium at any point where the hand-held printer 10 had previously scanned. The hand-held printer 10 can use stored images of pattern variations of the print medium or the printed portion of the image as references to reinitiate the printing process. The preferred method is to scan an area covered previously during the printing process. The light indicator 24 will turn "on" when the hand-held printer 10 has determined the relative position. Then, the printing process can resume. Although only horizontal paths are illustrated in FIG. 7, the hand-held printer 10 is not limited to horizontal printing paths. The direction of the hand-held printer 10 does not affect the printing process. The hand-held printer 10 can be manually manipulated in horizontal, vertical, diagonal, or even circular motions. The only requirement to print a complete image is that the entire area of the print medium, where the image is to be printed, must be scanned by the hand-held printer.

The hand-held printer 10 can also be used with various pre-printed papers having custom designs, such as forms or personalized letter paper. The designs can be loaded as design image data into the hand-held printer 10 by a storage disk, or can be scanned into the hand-held printer 10 using the navigation sensors 30. The designs can then be used as reference points during a printing process.

Figure 8:
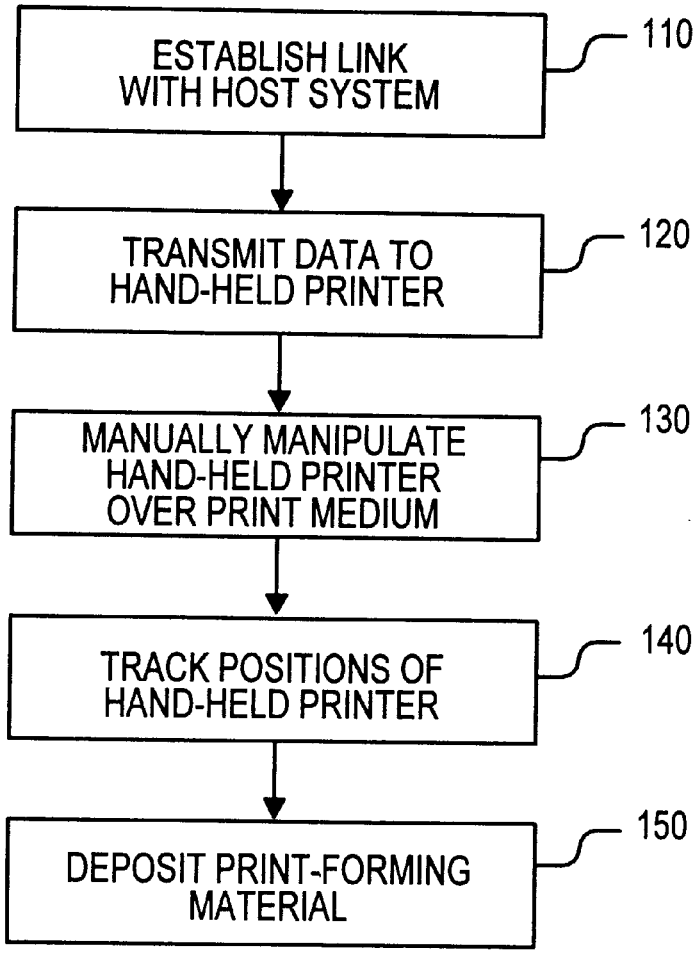
FIG. 8 is a flow diagram of a method of printing an image using the hand-held printer in accordance with the present invention.

FIG. 8 shows a flow diagram illustrating a method of printing an image using the hand-held printer 10 in accordance with the present invention. At step 110, a communication link is established between a host system and the hand-held printer 10. The host system is preferably a computer system such as a desktop computer or a laptop computer. In one embodiment, the communication link is established through a cable that physically connects the hand-held printer 10 with the host system. In another embodiment, the communication link is established though a wireless connection. In the wireless connection embodiment, infrared or radio frequency signals are utilized to transmit and receive data between the hand-held printer 10 and the host system.

In step 120, a frame of image data that represents the image to be printed is transmitted from the host system to the hand-held printer 10 through the communication link. At step 130, the hand-held printer 10 is manually manipulated across a print medium in order to print. The hand-held printer 10 is initially placed on a designated position on the print medium. While the hand-held printer 10 is manually manipulated, the hand-held printer 10 tracks positions of the hand-held printer 10 relative to the surface of the print medium and generates position data that indicates the relative position at step 140. The tracking of positions is accomplished by comparing surface images of the print medium captured by the navigation sensors in the hand-held printer 10. The comparison of the surface images may involve comparing images of fibers on the print medium or other pattern variations on the print medium. When the hand-held printer 10 is manipulated over a portion of the print medium in which the image is be printed, the hand-held printer 10 deposits print-forming material onto the surface of the print medium at step 150. The determination by the hand-held printer 10 to deposit print-forming material over a particular portion on the print medium involves correlating the position data with the frame of image data such that a section of the image can be printed on the corresponding location on the print medium.

What is claimed is:

1. A hand-held printing system for printing an image onto a print medium comprising:

a printer housing;

interface means affixed to said printer housing for receiving data representative of said image to be printed;

optical means affixed to said printer housing for forming navigation information that is responsive to optically imaged surface variations during non-linear navigation of said printer housing along said print medium, thereby generating non-linear navigation information, said optical means having an output indicative of two-dimensional positions of said printer housing relative to said print medium;

a supply of print-forming material; and print means for depositing said print-forming material onto said print medium in a sequence that is responsive to said non-linear navigation information and in an image pattern that is responsive to said data.

2. The system of claim 1 further comprising a navigation processor operatively associated with said optical means to monitor non-linear movement of said printer housing relative to said print medium.

3. The system of claim 2 wherein said print means includes printer driver software for converting said data to print data having a data arrangement determined by said non-linear navigation information.

4. The system of claim 1 wherein said optical means includes an optical sensor having an array of optoelectronic elements.

5. The system of claim 1 wherein said print means includes an inkjet cartridge and said supply of print-forming substance is ink within said inkjet cartridge.

6. The system of claim 1 wherein said interface means includes a transceiver that is capable of transmitting and receiving said data in either infrared or radio frequency signals.

7. The system of claim 1 wherein said interface means includes a cable for establishing a communication link to an external device.

8. The system of claim 1 wherein said interface means includes an input in communication with a host computer.

9. A printing system comprising:

a printer housing;

an input/output port attached to said printer housing for establishing a connection with an external device;

a printing mechanism contained within said printer housing, said printing mechanism having a print-forming region at an exterior surface of said printer housing to form an image onto an external surface in response to a two-dimensional movement of said printing mechanism with respect to said external surface; and an optical sensor having an array of optoelectronic elements located on said printer housing for monitoring pattern variations on said external surface, said optical sensor generating navigation information indicative of non-linear navigation of said print-forming region with respect to said external surface on which said image is to be printed, said optical sensor being operatively associated with said printing mechanism such that said printing mechanism is responsive to said navigation information and such that printing onto said external surface is in a sequence that is determined by said non-linear navigation information.

10. The system of claim 9 further comprising a navigation processor located within said printer housing, said navigation processor being operatively connected to said optical sensor, said navigation processor receiving said navigation information from said optical sensor during said non-linear navigation to ascertain changes in said relative position of said print-forming region with respect to said external surface.

11. The system of claim 10 further comprising memory located within said printer housing for storing said navigation information and image data received from said external device, said memory being coupled to said navigation processor.

12. The system of claim 11 further comprising a printer driver operatively associated with said memory and said processor to convert said image data into print data, said print data being transmitted to said printing mechanism.

13. The system of claim 9 wherein said printing mechanism includes an inkjet cartridge and a supply of ink within said inkjet cartridge.

14. The system of claim 9 wherein said input/output port includes a transceiver that is enabled for transmitting and receiving said data in either infrared or radio frequency signals.

15. A method of printing an image represented by a frame of image data using a hand-held printer having an optical sensor comprising steps of:

manually moving said hand-held printer adjacent to a surface on which a printed image is to be formed in a non-linear manner;

tracking two-dimensional positions of said hand-held printer relative to said surface by monitoring pattern variations on said surface using said optical sensor, including generating two-dimensional position data indicative of said two-dimensional positions; and depositing print-forming material onto said surface in a sequence determined by said two-dimensional position data such that a composite printed image is representative of said image data, including correlating said two-dimensional position data with said image data.

16. The method of claim 15 further comprising a step of receiving said frame of image data by said hand-held printer and generating print data within said hand-held printer to drive a printing mechanism of said hand-held printer in response to said frame of image data.

17. The method of claim 15 further comprising a step of establishing an infrared or a radio frequency communication link with a host system.

18. The method of claim 15 wherein said step of depositing said print-forming material includes utilizing inkjet printing techniques.

19. The method of claim 15 further comprising steps of removing said hand-held printer from said surface after said step of depositing said print-forming material onto said surface and then reinitiating said step of depositing said print-forming material onto said surface.

* * * * *